United States Patent [19]

Burysek et al.

[11] Patent Number: 4,883,231

[45] Date of Patent: Nov. 28, 1989

[54] COP TUBE TRANSPORTING DEVICE FOR TEXTILE MACHINES

[75] Inventors: Frantisek Burysek, Usti nad Orlici; Bohuslav Jirka, Upice; Zdenek Jarolimek, Bila Tremesnice; Ludvik Fajt, Usti nad Orlicii, all of Czechoslovakia

[73] Assignee: Vyzkumny ustav bavlnarsky, Usti nad Orlici, Czechoslovakia

[21] Appl. No.: 238,692

[22] Filed: Aug. 30, 1988

[30] Foreign Application Priority Data

Sep. 2, 1987 [CS] Czechoslovakia ..... 6374-87

[51] Int. Cl.[4] ..... B65H 67/04; B65H 67/06

[52] U.S. Cl. ..... 242/35.5 A

[58] Field of Search ..... 242/35.5 A, 35.5 R, 242/18 R

[56] References Cited

U.S. PATENT DOCUMENTS

| | | | |
|---|---|---|---|
| 4,066,218 | 1/1978 | Kamp | 242/35.5 A |
| 4,352,466 | 10/1982 | Baumges et al. | 242/35.5 A X |
| 4,638,956 | 1/1987 | Wey | 242/35.5 A |
| 4,655,665 | 4/1987 | Lattion | 242/35.5 A X |
| 4,772,171 | 9/1988 | Mayer et al. | 242/35.5 A X |

FOREIGN PATENT DOCUMENTS

| | | | |
|---|---|---|---|
| 233522 | 8/1986 | Czechoslovakia . | |
| 2816418 | 10/1979 | Fed. Rep. of Germany | 242/35.5 A |

*Primary Examiner*—Stanley N. Gilreath

*Attorney, Agent, or Firm*—Klein & Vibber

[57] ABSTRACT

An easy and simple transport of cop tubes to a travelling automatic service unit for exchanging wound packages for empty tubes has a conveyor in the form of a flat belt supported by upper slide surfaces of supporting walls fixed onto beams of the machine frame. The walls, together with the belt are inclined to the horizontal plane at an angle of at least 10 degrees, and at most 45 degrees.

12 Claims, 2 Drawing Sheets

COP TUBE TRANSPORTING DEVICE FOR TEXTILE MACHINES

FIELD OF THE INVENTION

The invention relates to a cop tube transporting device for textile machines, comprising a conveyor arranged on beams along the machine frame, and at least one guiding support surface for guiding tubes from a magazine provided at one machine end to tube withdrawing means of a travelling automatic service unit for exchanging wound packages for empty tubes on a spooling device of the machine.

BACKGROUND OF THE INVENTION

For the automatic exchange of wound packages with empty tubes by means of spooling devices of textile machines, and particularly open-end rotor spinning machines, an automatic service unit adapted for travelling along the machine is known. In this case, empty tubes are received in a magazine provided in this service unit. Since this mode has many disadvantages, another one has been adopted, wherein cop tubes are supplied from a magazine provided at one machine end by means of a channel and a conveyor extending along the machine above the spinning units, and taken off the conveyor by the travelling service unit.

In a known device a channel with a guiding support surface is arranged along the machine above the spinning units. This surface has two oblique channel walls and a bottom in which a through slit for a carrier of the tube feeding conveyor is provided. The carrier, engaging into the channel, is secured to a movable pull rod extending under the channel. This device is relatively complicated and expensive, since the carriers are mounted for rotation on the movable pull rod which itself is adapted for reciprocatory rotation and for forwarding stepwise in a longitudinal direction.

A device has been disclosed having a stationary channel with a gap in its bottom, also for the passage of a carrier of the stepwise movable conveyor provided with a leverage system for lifting the carrier. After the exchange of a tube, the entire column of empty tubes is forwarded from the machine end or the magazine, respectively, up to the free place left after the withdrawn tube. This device is also relatively complicated and considerably expensive.

It is an object of the invention to eliminate the drawbacks of the prior art as hereinabove referred to and to provide an improved device for transporting tubes to the travelling automatic service unit for exchanging wound packages for empty tubes by means of a conveyor extending along the machine frame, in a reliable and inexpensive way in view of both manufacture and maintenance thereof so as to enable the tube to be reliably taken over by the automatic unit, which means to ensure a constant position of an empty tube relative to said unit.

SUMMARY OF THE INVENTION

According to the invention, the conveyor comprises an endless flat belt supported by upper slide surfaces provided on supporting walls of beams carried by the machine frame. The supporting walls, together with the conveyor are inclined to the horizontal plane at an angle of at least 10 degrees, and at most 45 degrees.

An advantage of the inventive device resides in its considerable simplicity, the inclination of the conveying belt and the supporting walls relative to the guiding support surface enabling a constant position of the tube relative to the automatic unit.

In a preferred embodiment of the device, the supporting walls for the upper strand of the conveyor belt are fixed onto the upper surface of brackets outstanding forward from the beams of the machine frame while the supporting walls designed for the lower strand of the conveyor belt are fixed onto the lower surface of the brackets, both of the supporting walls being provided at their outer ends with an upward extending guard lip for preventing the tube from falling out, or the belt from running off.

In another preferred embodiment, the guiding support surface extends below a middle plane led through the central axis of the tube at the place of minimum diameter thereof in parallel to the plane of the flat conveyor belt.

The guiding support surface is spaced apart from the flat conveyor belt, preferably at a distance varying from one fifth to one half of radius of the tube in the region of the minimum diameter thereof. This arrangement is particularly advantageous for conical tubes, since it makes it possible to obtain the relatively least deflection of the minor diameter end of the tube from the opposite major diameter end thereof.

Preferably, the guiding support surface is provided on a guide fixedly attached to the beams and extending in parallel to the conveyor belt.

The guide with its guiding supporting surface may be either stationary on the beams, or, preferably, movable together with the conveyor belt. In the latter case, the guide may comprise e.g. an endless rope of circular cross-section. A cross-section of the guide is advantageous even in case it is stationary and supported by the beams, for example, in a groove. This embodiment is preferred not only from the viewpoint of operation but also of manufacture because of its low cost.

The conveyor belt of an advantageous embodiment is supported by a driving pulley carried directly by the shaft of an electric motor which is inclined from the horizontal plane at the same angle as the supporting walls together with the conveyor belt. The speed rate of such a motor has to be adapted to the desired belt velocity, it being also preferable when a common pulley carries both the conveyor belt and the guide with the guiding support surface, said guide being movable in the beam grooves.

With the practical embodiment in view, it is advantageous when the supporting walls and the guide together with the guiding support surface are divided into sections along the conveyor belt, and particularly if the length of such sections corresponds to that of machine frame sections. Between the sections of the supporting walls there are provided gaps of at least 5 mm width. The gap edges assume then the function of strippers for cleaning the conveyor belt from dust, fibre remainders, or the like.

BRIEF DESCRIPTION OF THE DRAWING

With these and other objects in view, which will become apparent in the following detailed description, the present invention, which is shown by example only, will be clearly understood in connection with the accompanying drawing, in which.

DESCRIPTION OF THE PREFERRED EMBODIMENTS

Figure 1:
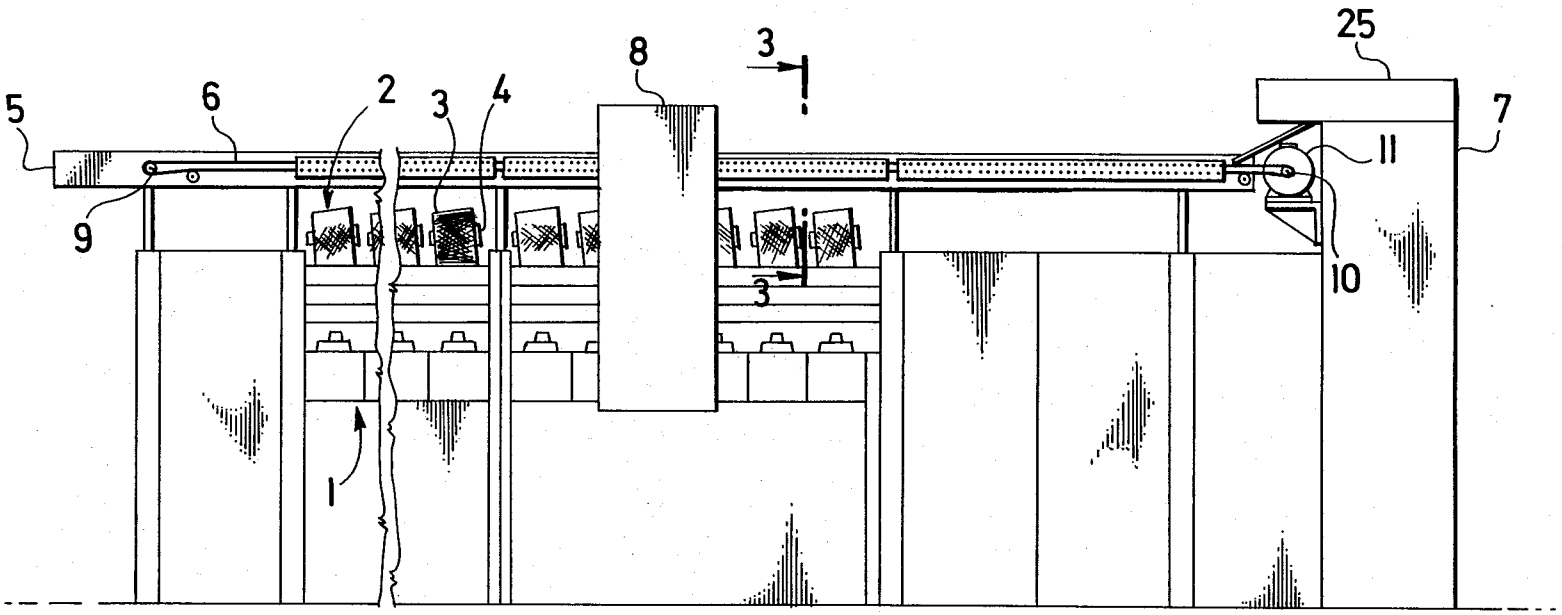
FIG. 1 is a full front view of a textile machine together with a travelling automatic service unit.

FIG. 1 shows, in a front view, a total scheme of a cop tube transporting device in a textile machine such as, in this case, an open-end rotor spinning machine containing spinning units 1. Above the machine, a well-known spooling device 2 is provided for winding yarn on tubes 4 to form packages 3. In the shown embodiment, conical tubes are used.

The reference numeral 8 indicates a well-known automatic service unit mounted for travelling along the machine and serving for exchanging wound packages 3 for empty tubes 4.

Above the spooling device 2 there is provided on the machine frame 5 a conveyor comprising a flat belt 6. At the right-hand side of the machine is a magazine 7 for empty tubes 4 having a well-known device 25 for transferring the tubes 4 onto the conveyor belt 6. The latter encompasses an idle pulley 9 and a driving pulley 10 preferably carried directly by the shaft of an electric motor 11. However, the driving pulley 10 can be carried by the output shaft of a gearbox coupled with the electric motor 11.

Figure 2:
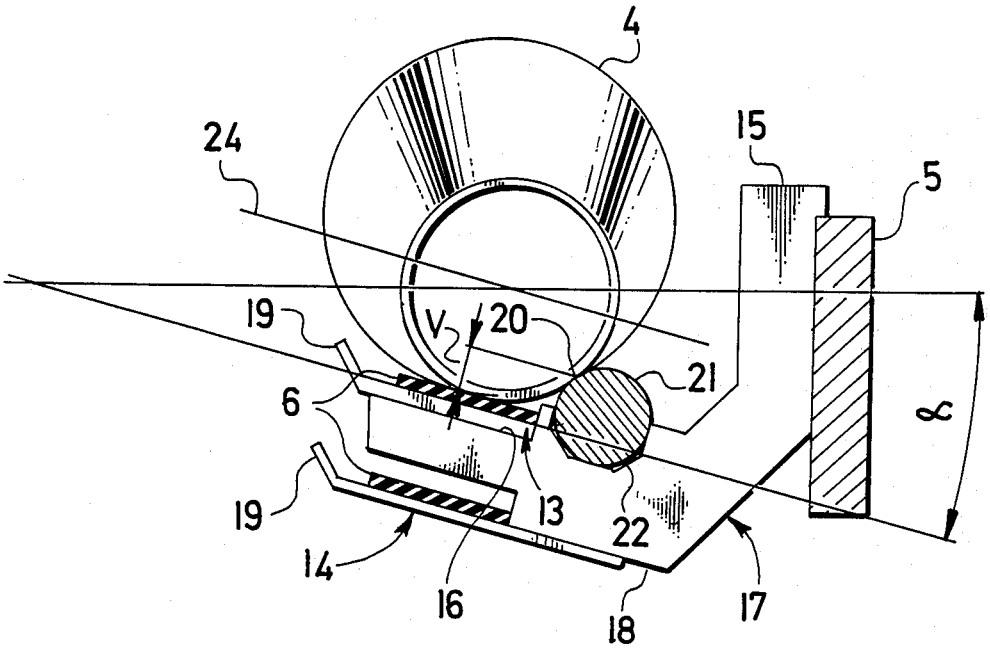
FIG. 2 is a cross-section taken along the line II—II in FIG. 1, showing the conveyor belt together with the beam and a conical tube bearing on the guiding support surface of the guide.

FIG. 2 shows the conveyor belt 6 and the arrangement thereof on the machine. The endless flat conveyor belt 6 is led on upper slide surfaces 12 of supporting walls 13, 14 secured to beams 15 which are fixedly attached by suitable connecting means to the machine frame 5. The supporting wall 13, or more such walls in case of a sectional arrangement thereof, for the upper strand of the belt 6 is fixed onto the upper surface 16 of brackets 17 outstanding from the beams 15 on the machine frame 5 while the supporting wall 14 for the lower belt strand is provided on lower surface 18 of said brackets 17. The supporting walls 13 and 14 are provided at their outer ends with upwards extending guard lips 19 for preventing the tube from falling out and the conveyor belt 6 from running off. The supporting walls 13, 14 together with the belt 6 or, respectively, also with the brackets 17 of the beam 15 are inclined to the horizontal plane at an angle of at least 10 degrees, and at most 45 degrees.

The guiding support surface 20 is provided on a guide 21 which is secured to the beams 15 and is oriented in parallel to the conveyor belt 6. The guide 21 preferably comprises a rod of circular cross-section which is fixed in a groove 22 provided in the brackets 17 of the beam 15. However, the guide 21 can alternatively consist of an endless rope which is arranged in said groove 22 of the beam 15 or the brackets 17 thereof, respectively, so as to move simultaneously with the conveyor belt 6. In this case, both the guide 21 and the conveyor belt 6 are supported by common driving pulleys 10 on the shaft of the electric motor 11. A characteristic feature of the device resides in that the guide 21 or its guiding support surface 20, respectively, is disposed below a middle plane 24 led through the central axis of the tube 4 at the side of its minimum diameter in parallel to the plane of the flat conveyor belt 6.

The guiding support surface 20 is preferably spaced apart from the flat conveyor belt 6 at a distance V varying from one fifth to one half of the tube radius in the region of its minimum diameter, in perpendicular direction to the belt 6.

Figure 3:
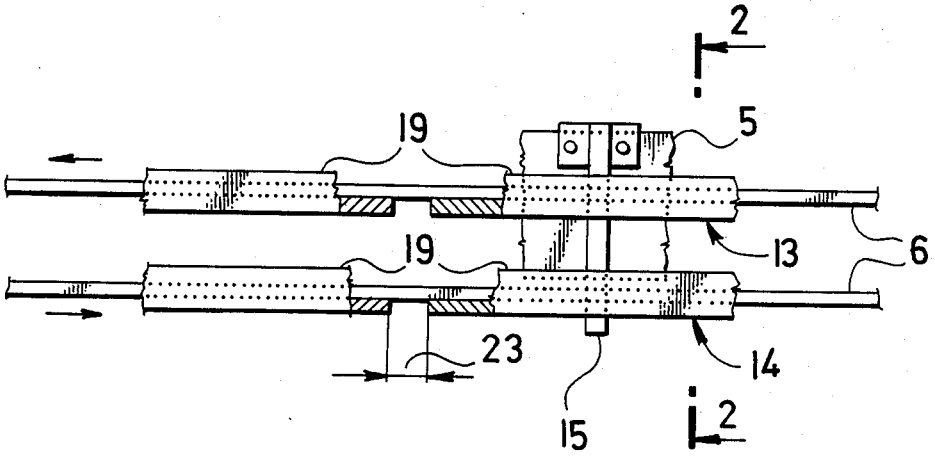
FIG. 3 is a detail front view showing a sectional arrangement of a supporting wall supported on the machine frame beams.

The supporting walls 13, 14 are either integral along the entire machine, or divided into sections as it is apparent from FIG. 3. As well, the guide 21 with the guiding support surface 20, if stationary, forms either an integral object, or is divided into sections. In case of the sectional arrangement of supporting walls 13, 14 it is advantageous when gaps 23 of at least 5 mm width are provided between the sections. The edges of the supporting walls 13, 14 assume, in this case, the function of stripping elements for removing dust and other impurities from the conveyor belt 6. The length of individual supporting wall sections or sections of guides 21, respectively, should preferably correspond to that of machine frame sections. This facilitates then the assembly of machine frame sections together.

MANNER OF OPERATION

In operation, empty tubes 4 are supplied one after the other by means of a well-known transferring device 25 onto the conveyor belt 6 running towards the travelling automatic service unit 8. The tube 4, once deposited on the belt 6, bears, due to the belt inclination, on the guiding support surface 20 of the guide 21. Since the guiding support surface 20 is oriented below the middle plane 24, no excessive deflection of the minor diameter tube end relative to the opposite major diameter tube end occurs. The conveyor belt 6 carries then the tube 4 along toward the service unit 8, the tube 4 being prevented from slipping by friction between itself and the belt. In case of the movable guide 21, the tube 4 is carried along also by said guide. The travelling automatic service unit 8 will take over the empty tube 4 in a well-known way and exchange it in cooperation with the spooling device 2 for a wound package 3.

Although the invention is described and illustrated with reference to a plurality of embodiments thereof, it is to be expressly understood that it is in no way limited to the disclosure of such preferred embodiments but is capable of numerous modifications within the scope of the appended claims.

We claim:

1. A cop tube transporting device for a textile machine for guiding tubes from a magazine at one end of the machine to tube withdrawing means of a travelling automatic service unit, said device comprising a conveyor arranged along the machine, and a guiding support surface;

the conveyor comprising an endless flat conveyor belt, said conveyor belt being supported by an upper slide surface of an upper supporting wall, said supporting wall being mounted to said machine;

said supporting wall together with said conveyor belt being inclined to a horizontal plane at an angle of at least 10 degrees, and at most 45 degrees.

2. A device according to claim 1, further comprising a lower supporting wall, wherein the supporting walls are carried by a bracket having an upper and lower surface;

said upper supporting wall being fixed onto the upper surface of said bracket and said lower supporting wall being fixed onto the lower surface of said bracket;

both of said supporting walls being provided at their outer ends with an upward extending guard lip for preventing the tube from falling out, or the belt from running off.

3. A device according to claim 1, wherein the guiding support surface extends below a middle plane led through the central axis of the tube at the place of minimum diameter in parallel to the plane of the flat conveyor belt.

4. A device according to claim 1, wherein the guiding support surface is spaced apart from the flat conveyor belt at a distance varying from one fifth to one half of radius of the tube in the region of the minimum diameter of said tube.

5. A device according to claim 1, wherein the guiding support surface is provided on a guide extending in parallel to the conveyor belt.

6. A device according to claim 5, wherein the guide with its guiding support surface is stationary.

7. A device according to claim 5, wherein the guide with its guiding support surface comprises an endless rope led in a channel to move simultaneously with the conveyor belt.

8. A device according to claim 7, wherein both the guide and the conveyor belt encompass common driving pulleys.

9. A device according to claim 8, wherein an electric motor carries the driving pulleys and said electric motor is inclined from ther horizontal plane at the same angle as the supporting wall together with the conveyor belt.

10. A device according to claim 5, wherein the supporting wall and the guide together with the guiding surface are divided into sections along the conveyor belt.

11. A device according to claim 10, wherein gaps of at least 5 mm width are provided between the sections of the supporting wall.

12. A device according to claim 10, wherein the length of sections of the supporting wall and of the guides with the guiding support surface corresponds to the length of the individual machine frame sections.

* * * * *